US005216377A

United States Patent [19]

Nakata et al.

[11] Patent Number: 5,216,377

[45] Date of Patent: Jun. 1, 1993

[54] APPARATUS FOR ACCUMULATING CHARGED PARTICLES WITH HIGH SPEED PULSE ELECTROMAGNET

[75] Inventors: Shuhei Nakata; Chihiro Tsukishima, both of Amagasaki, Japan

[73] Assignee: Mitsubishi Denki Kabushiki Kaisha, Tokyo, Japan

[21] Appl. No.: 861,437

[22] Filed: Apr. 1, 1992

Related U.S. Application Data

[62] Division of Ser. No. 440,250, Nov. 22, 1989, Pat. No. 5,138,270.

[30] Foreign Application Priority Data

| | | | |
|---|---|---|---|
| Nov. 24, 1988 | [JP] | Japan | 63-294663 |
| Dec. 22, 1988 | [JP] | Japan | 63-322125 |
| Feb. 13, 1989 | [JP] | Japan | 1-31151 |
| Mar. 17, 1989 | [JP] | Japan | 1-65660 |

[51] Int. Cl.[5] ..... H05H 7/08

[52] U.S. Cl. ..... 328/233; 328/228; 328/230; 328/235

[58] Field of Search ..... 328/233, 235, 228, 230; 315/3.5, 5.35

[56] References Cited

U.S. PATENT DOCUMENTS

| | | | |
|---|---|---|---|
| 2,837,638 | 6/1958 | Frink | 328/67 |
| 3,344,357 | 9/1967 | Blewett | 328/233 |
| 3,432,664 | 3/1969 | Robison | 328/67 |
| 4,482,816 | 11/1984 | Richardson et al. | 328/67 |
| 4,808,941 | 2/1989 | Marsing | 328/235 |
| 4,812,774 | 3/1989 | Tsumaki et al. | 328/228 |
| 5,006,759 | 4/1991 | Krispel | 328/228 |

OTHER PUBLICATIONS

"Design of Injector Synchrotron" UVSOR-7; Mar., 1981.

"Design of UVSOR Storage Ring" UVSOR-9, Dec., 1982.

Tell-Teras Activity Report, 1980-1986, Lina and Storage Ring Facilities Electrotechnical Laboratory.

Experiment of Fast-Electron Extraction System, S. Nakata, 1987, Mitsubishi Electric Corp., Japan.

Design of Injector Synchrotron, Institute for Molecular Science Myodaiji, Okasaki, Mar. 1981.

*Primary Examiner*—John S. Heyman

*Attorney, Agent, or Firm*—Leydig, Voit & Mayer

[57] ABSTRACT

A high speed pulse electromagnet of a charged particle accumulator having a structure for producing magnetic field components of at least four poles from the periphery to the center to make the orbital path for incident charged particles passed through a low speed pulse electromagnet coincide with the orbital path for stored charged particles.

5 Claims, 3 Drawing Sheets

APPARATUS FOR ACCUMULATING CHARGED PARTICLES WITH HIGH SPEED PULSE ELECTROMAGNET

This application is a divisional of application Ser. No. 07/440,250, filed Nov. 22, 1989, now U.S. Pat. No. 5,138,270.

BACKGROUND OF THE INVENTION

1. Field of the Invention

This invention relates generally to an apparatus for accumulating charged particles and, more particularly, to a charged particle accumulator used as, for example, a light source for producing synchrotron radiation light.

2. Description of the Related Art

FIG. 1 schematically shows the construction of a conventional charged particle accumulator, such as the one described on p. 22 of TELL-TERAS ACTIVITY REPORT (1980–1986), which has a vacuum vessel 1 in the form of a ring, deflecting electromagnets 2, quadrupole electromagnets 3, a low speed pulse electromagnet 4, a high speed pulse electromagnet 5 and a high frequency cavity 6. These components constitute an accumulating ring. High speed electrons are generated by a linear electron accelerator 7.

FIG. 2 shows a locus of a charged particle in a phase plane at the outlet of the low speed pulse electromagnet 4. In FIG. 2, the abscissa represents the deviation from the central orbital path and the ordinate represents the inclination of the charged particle beam from the center axis. A point 8 represents the position of an incident charged particle at the outlet of the low speed pulse electromagnet 4. A point 9 designates the state of the incident charged particle at the position of the high speed pulse electromagnet 5. A point 10 designates the state of the incident charged particle after the same has passed through the pulse electromagnet 5. A point 11 designates the state of the incident charged particle when the same returns to the position of the low speed pulse electromagnet 4. A point 12 represents the position of the incident particle when the same completes one revolution through the accumulating ring. Points 13 and 17 represent the positions of accumulated charged particles. A wall 18 represents a side wall of the low speed pulse electromagnet 4.

The conventional charged particle accumulator is thus constructed as explained above. The motion of charged particles at the time of introduction will be explained below. The path for electrons generated by the linear electron accelerator 7 is deflected by the low speed pulse electromagnet 4 so that each electron enters into a state such as that represented by the point 8 in FIG. 2. When the electron comes to the high speed pulse electromagnet 5, the position of the electron in the phase plane is as represented by the point 9. At this time, the inclination of the electron is changed in a step manner by the vertical magnetic field produced by the high speed pulse electromagnet 5 so that the state of the electron is changed to that represented by the point 10. When the electron thereafter comes to the low speed pulse electromagnet 4 again, the position of the electron is at the point 11., When the electron thereafter comes to the low speed pulse electromagnet 4 by undergoing the above-described effect over again, the position of the electron is at the point 12. The electron moves in the phase plane by repeating this cycle. If the electron does not collide against the side wall 18 until the magnetic field of the high speed pulse electromagnet 5 is extinguished, the electron introduced from the outside is considered to be stored in the accumulator. On the other hand, the positions of other electrons already stored move successively from the point 13 to the point 17 as they undergo the same effect.

This process will be explained below in more detail. The pulse electromagnet 5 produces, in the orbital path for the charged particle beam, a magnetic field in the vertical direction alone to deflect the charged particle beam path to a certain extent. The need for the pulse electromagnet 5 is based on the following reason. In a case where only a magnetic field constant with respect to time acts on the beam, the beam proceeds along a line such as that represented by the circular arc concentric with the center axis of the phase plane of FIG. 2. That is, the beam proceeds along the circular arc passing through the point 8 as indicated by the broken line in FIG. 2, and thereafter returns to the position of the point 8. In this case, however, the beam cannot be introduced because it collides against the side wall 18 of the low speed pulse electromagnet 4. To maintain the introduced beam inside the accumulator, it is necessary to deflect for only a certain period of time the orbital path for the beam by the pulse electromagnet 5. If the current for the pulse electromagnet 5 is shut off, for example, after the introduced beam has been changed to the position of the point 10, the beam thereafter proceeds in accordance with the circular arc concentric with the center axis of FIG. 2, as indicated by the broken line passing through the point 10. Thus, the introduced beam traces the orbital path located inside the first position in FIG. 2 and does not deviate outwardly from this path.

This conventional charged particle accumulator entails various problems which reside in that 1) the orbital paths for stored charged particles are disturbed because the high speed pulse electromagnet 5 uniformly produces the vertical magnetic field;

2) the capacity of the power source for the high speed pulse electromagnet is large because the space to be filled with the produced magnetic field is large;

3) The next charged particles to be stored cannot be introduced until the changed orbital paths for the stored charged particles are restored;

4) for this reason, the accumulator cannot be used as a synchrotron radiation light source during introduction;

5) introduced charged particles collide against the side wall of the low speed pulse electromagnet unless the pulse width for the high speed pulse electromagnet is sufficiently small;

6) a further increase in the power source capacity is therefore required; and 7) introduced charged particles pass through a point at a large distance from the central orbital path, and it is necessary to increase the effective range of the magnetic field of each of the deflection electromagnet and the quadrupole electromagnet of the accumulating ring.

SUMMARY OF THE INVENTION

In view of these problems, an object of the present invention is to provide a charged particle accumulator having a high speed pulse electromagnet which enables incident charged particles to be introduced without disturbing stored charged particles and which is capable of operating with pulses having a larger pulse width and with a power source having a smaller capacity, the charged particle accumulator being capable of being used as a light source while introducing charged particles.

The present invention provides a changed particle accumulator having a high speed pulse electromagnet for producing magnetic field components of at least four poles.

In accordance with the present invention, the directions of magnetic fields produced by the high speed pulse electromagnet are opposite to each other and symmetrical about the center axis. The intensity of the magnetic field is proportional to the distance from the center axis (proportional to x in the phase plane of FIG. 4. As a charged particle introduced from the outside deviates from the center axis, the magnetic field force acting on the charged particle becomes greater, and the charged particle is thereby forced back to the center axis. The position of charged particle as represented in the phase plane each time the particle makes one revolution is symmetrical about the origin with the previous position (in a certain straight line passing through the origin). The charged particle is thereby converged to the center axis of the beam path.

DESCRIPTION OF THE PREFERRED EMBODIMENTS

Figure 1:
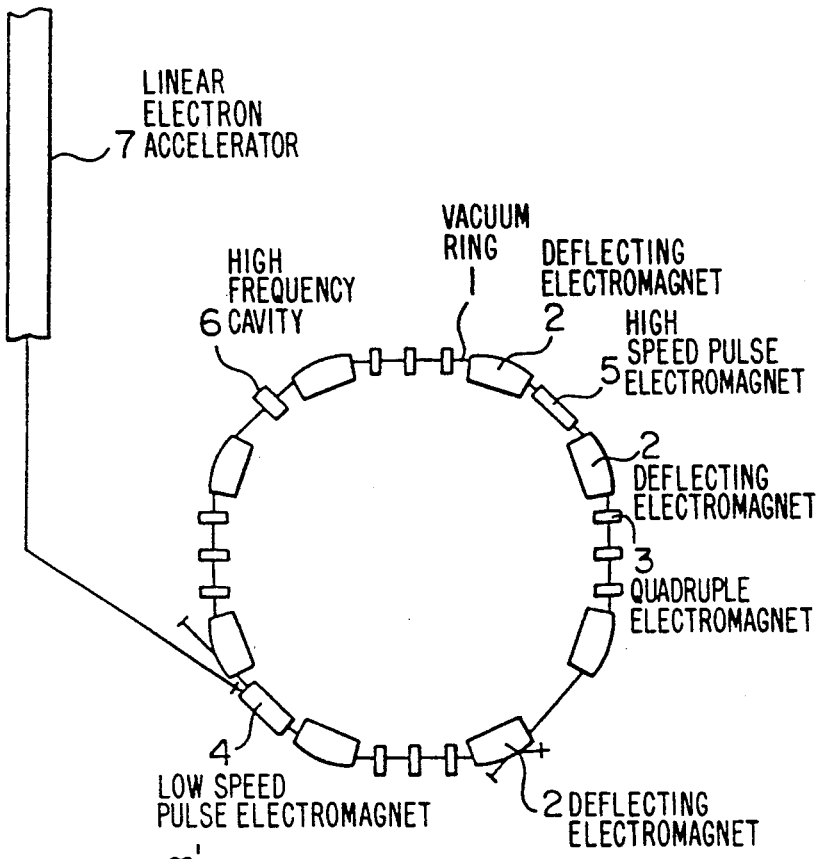
FIG. 1 PRIOR ART
FIG. 1 is a schematic plan view of a conventional charged particle accumulator.
Figure 2:
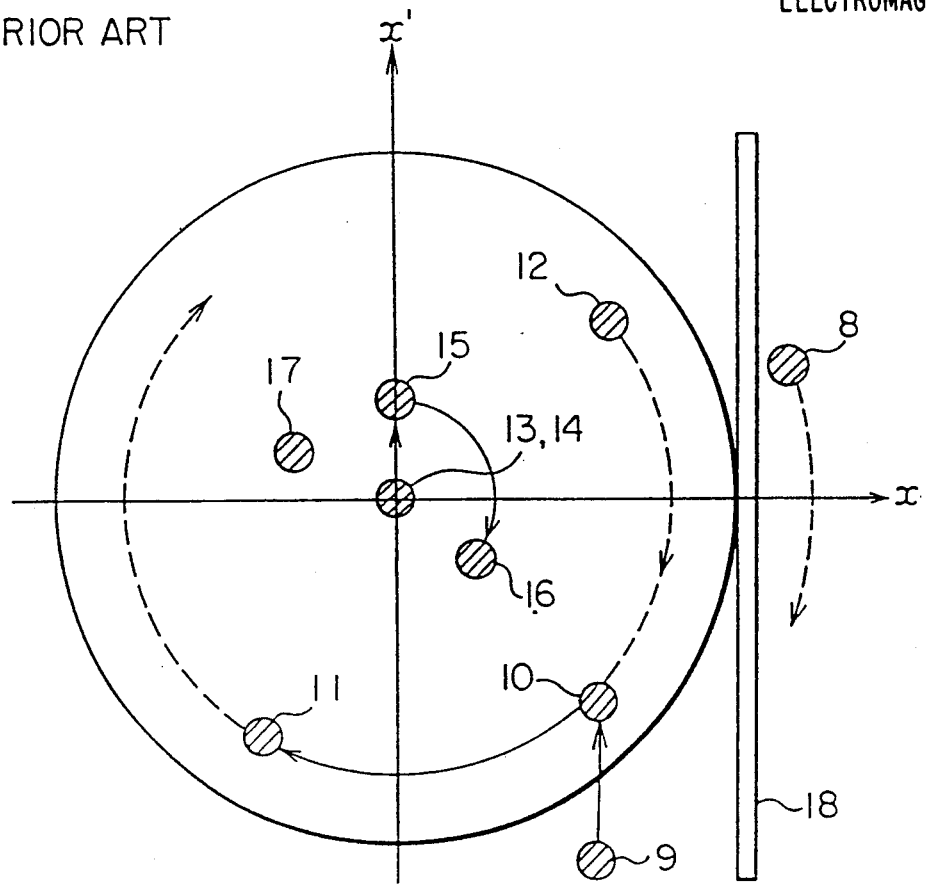
FIG. 2 PRIOR ART
FIG. 2 is a diagram showing in a phase plane the motions of charged particles in the accumulator shown in FIG. 1.
Figure 3:
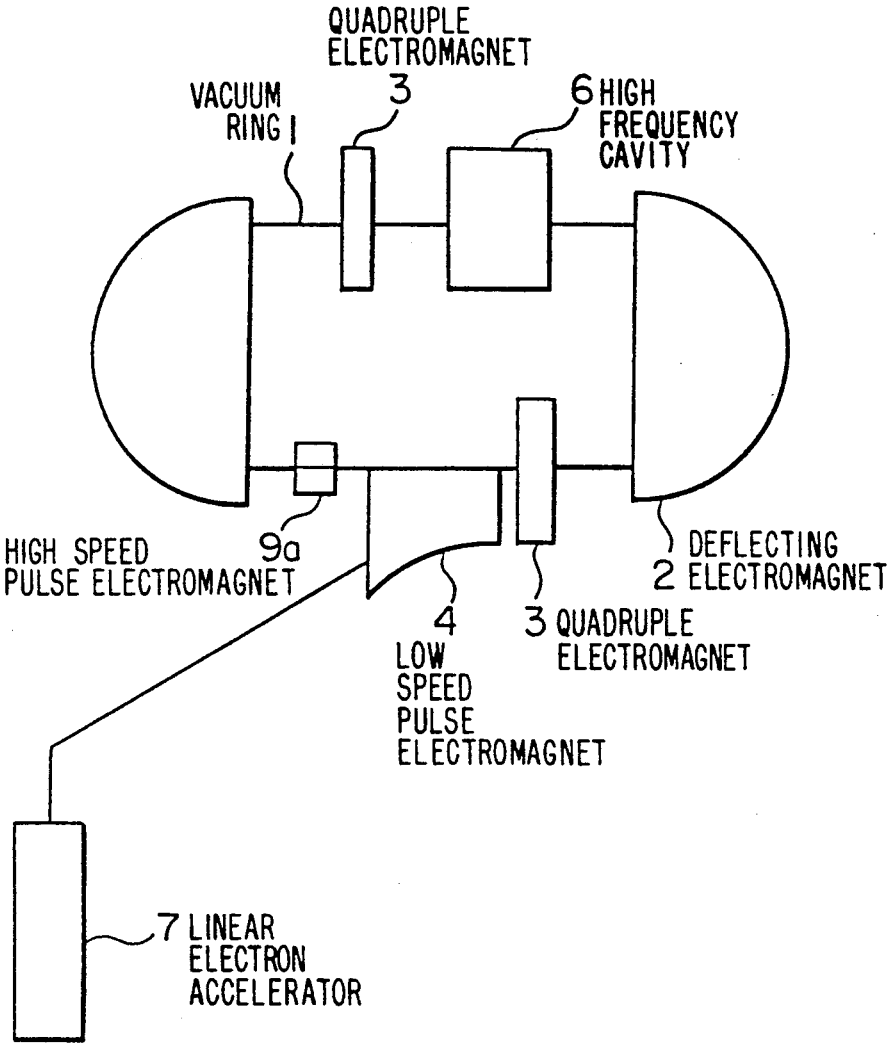
FIG. 3 is a schematic plan view of a charged particle accumulator embodying present invention.
Figure 3A:
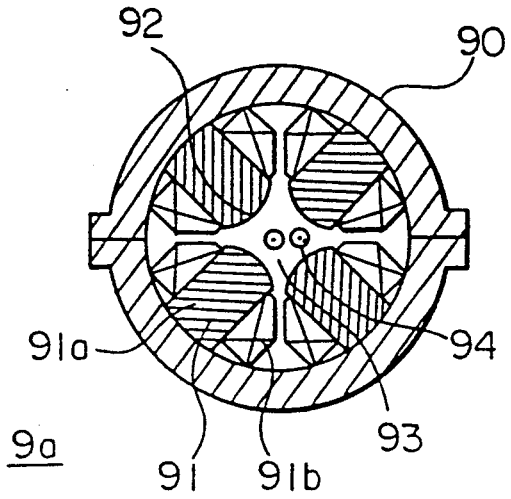
FIG. 3A is a transverse sectional view of an embodiment of the high speed pulse electromagnet of the accumulator shown in FIG. 3.

FIG. 3 is a schematic plan view of a charged particle accumulator which represents an embodiment of the present invention. A high speed pulse electromagnet 9*a* produces a quadrupole magnetic field. Other components are identical to those indicated by the same reference characters in FIG. 1. FIG. 3A shows an embodiment of the high speed pulse electromagnet 9*a* in transverse cross section. A quadrupole electromagnet 91 for generating a quadrupole magnetic field is disposed inside a yoke 90. The quadrupole electromagnet 91 comprises four electromagnets each of which includes a core 91*a* and a coil 91*b*. Each of these electromagnets produces a magnetic field directed toward the center of a vacuum vessel 92. Points 93 and 94 shown inside the vacuum vessel 92 represent the position of a stored charged particle and the position of an incident charged particle, respectively.

Figure 4:
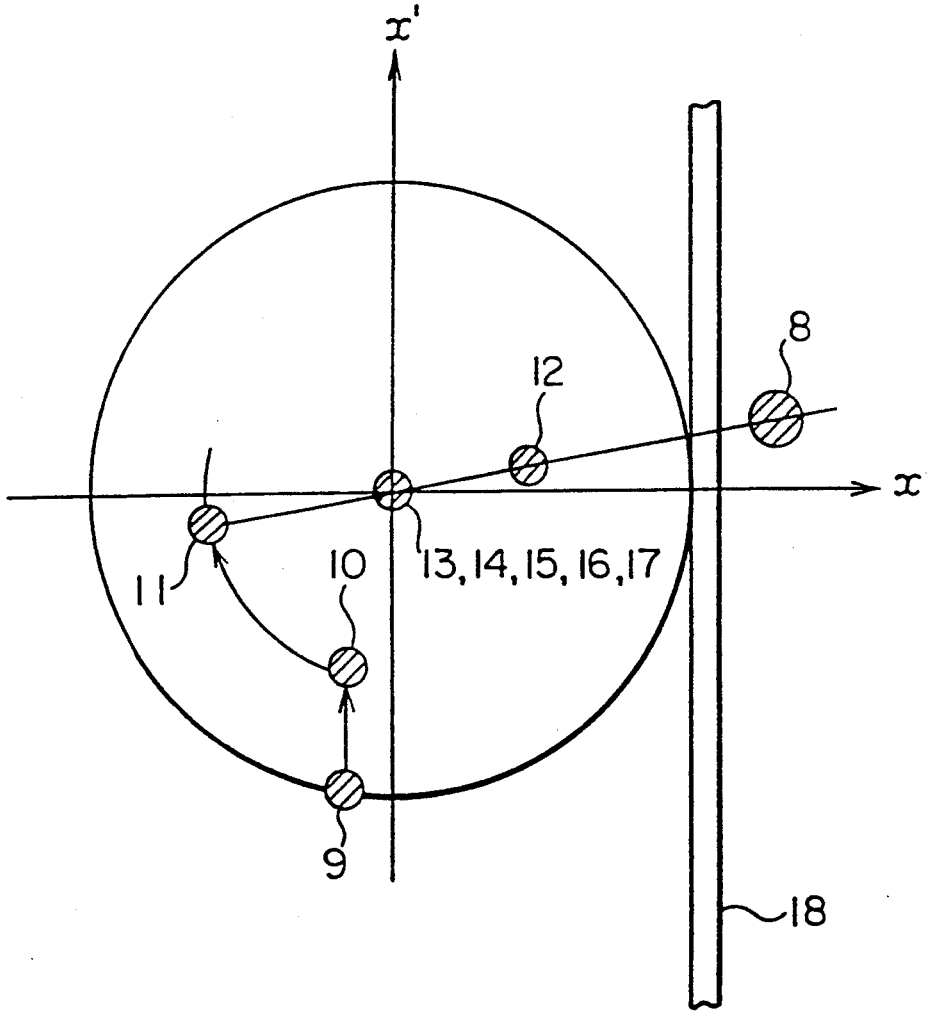
FIG. 4 is a diagram showing in a phase plane the motions of charged particles in the accumulator shown in FIG. 3.

FIG. 4 shows a locus of a charged particle in a phase plane at the outlet of a low speed pulse electromagnet 4. In FIG. 4, a point 8 represents the position of an incident charged particle at the outlet of the low speed pulse electromagnet 4. A point 9 designates the state of the incident charged particle at the position of the high speed pulse electromagnet 9*a*. A point 10 designates the state of the incident charged particle after the same has passed through the high speed pulse electromagnet 9*a*. A point 11 designates the state of the incident charged particle when the same returns to the position of the low speed electromagnet 4. A point 12 represents the position of the incident particle when the same completes one revolution through the accumulating ring. Points 13 to 17 represent the positions of loci of accumulated charged particles. A wall 18 represents a side wall of the low speed pulse electromagnet 14.

In the accumulator thus constructed, the path for electrons generated by the linear electron accelerator 7 is deflected by the low speed pulse electromagnet 4 so that each electron comes into a state such as that represented by the point 8 in FIG. 4. When the electron comes to the high speed pulse electromagnet 9*a*, the position of the electron in the phase plane is as represented by the point 9. At this time, the inclination of the electron is changed in a step manner by the vertical magnetic field produced by the high speed pulse electromagnet 9*a* so that the state of the electron is changed to that represented by the point 10. The position of the point 11 reached by the electron when the same thereafter comes to the low speed pulse electromagnet 4 again can be brought to the position symmetrical with the point 8 about the origin if the strength of the high speed pulse electromagnet 9*a* is suitably selected. If the current flowing through the high speed pulse electromagnet 9*a* is a rectangular wave current, the introduced charged particle can always move along the straight line connecting the point 8 and the origin, since the intensity of the magnetic field produced by the high speed pulse electromagnet 9*a* is proportional to the distance to the center. When the electron thereafter comes to the low speed pulse electromagnet 4 by undergoing the same effect, the position of the electron reaches the point 12. The electron moves for convergence to the origin in the phase plane by repeating this cycle. Thus, the introduced charged particle can be stored in the ring without being lost, even if the large pulse width for the high speed pulse electromagnet 9*a* is increased. On the other hand, the positions of charged particles already stored are in the vicinity of the origin; they are not influenced by the high speed pulse electromagnet 9*a* because the intensity of the magnetic field produced by the high speed pulse electromagnetic 9*a* is substantially zero.

In this embodiment, the quadrupole electromagnet is used as a high speed pulse electromagnet. However, the same effects can be expected even in a case where a multipole electromagnet capable of producing a magnetic field of a higher order is used.

In this embodiment, a rectangular wave current is used as the current for the high speed pulse electromagnet, but the same effects can also be expected by using a different current having, e.g., a damped oscillation wave, a sine half wave or a triangular wave.

As described above, a multipole electromagnet is used in place of the conventional high speed pulse electromagnet for producing a vertical magnetic field, thereby enabling charged particles to be introduced from the outside without any considerable influence upon the stored particles. The described embodiment also achieves a reduction in the extent of divergence of introduced charged particles and thereby makes it possible to reduce the effective ranges of the magnetic fields of the deflecting electromagnet and the quadrupole electromagnet of the accumulating ring and, hence, to reduce the size of each electromagnet.

What is claimed is:

1. An apparatus for accumulating charged particles, comprising:

a vacuum vessel in the form of a doughnut for accumulating charged particles;

a linear electron accelerator for generating incident charged particles and supplying the same to said vacuum vessel;

at least one deflection electromagnet for deflecting the path for charged particles by the effect of a magnetic field;

at least one quadrupole electromagnet for converging the charged particles;

a high frequency cavity for accelerating the charged particles;

a low speed pulse electromagnet for deflecting the path for the incident charged particles supplied from said linear electron accelerator to said vacuum vessel so as to adjust the path to the orbital path for stored charged particles; and a high speed pulse electromagnet for producing magnetic field components of at least four poles directed from the periphery of said vacuum vessel toward the orbital path for stored charged particles on the center axis of said vessel to make the orbital path for the incident charged particles passed through said low speed pulse electromagnet coincide with the orbital path for the stored charged particles without causing any substantial disturbance of the stored charged particles, said deflection electromagnet, said quadrupole electromagnet, said high frequency cavity, said low speed pulse electromagnet and said high speed pulse electromagnet being disposed along said vacuum vessel so as to respectively encircle the same.

2. An apparatus for accumulating charged particles according to claim 1, wherein said high speed pulse electromagnet includes: at least four pulse electromagnets disposed at equal intervals around said vacuum vessel so as to encircle the same about the center axis thereof, each of said four pulse electromagnets being capable of producing a magnetic field directed toward the center axis of said vacuum vessel; and a yoke surrounding said four electromagnets.

3. An apparatus for accumulating charged particles according to claim 2, wherein the intensity of the magnetic field produced by said at least four pulse electromagnets of said high speed pulse electromagnet is set so that the position of the orbital path for each incident charged particle determined at a predetermined point along the orbital path for the charged particles in said vacuum vessel each time that charged particle makes one revolution is, when represented in a phase plane, always symmetrical about the origin thereof with the position in the phase plane exhibited at the moment when the preceding revolution is completed at the predetermined point.

4. An apparatus for accumulating charged particles according to claim 3, wherein a current having a rectangular waveform flows through said high speed pulse electromagnet.

5. An apparatus for accumulating charged particles according to claim 3, wherein a current having at least one of a damped oscillation wave, a sine half wave and a triangular wave flows through said high speed pulse electromagnet.

* * * * *